US009239194B2

(12) United States Patent
Rasmussen

(10) Patent No.: US 9,239,194 B2
(45) Date of Patent: Jan. 19, 2016

(54) HEAT EXCHANGER SYSTEM FOR A DEODORISER

(75) Inventor: Preben Rasmussen, Helsinge (DK)

(73) Assignee: ALFA LAVAL CORPORATE AB, Lund (SE)

( * ) Notice: Subject to any disclaimer, the term of this patent is extended or adjusted under 35 U.S.C. 154(b) by 939 days.

(21) Appl. No.: 13/389,863

(22) PCT Filed: Jul. 15, 2010

(86) PCT No.: PCT/SE2010/050844
§ 371 (c)(1),
(2), (4) Date: Apr. 17, 2012

(87) PCT Pub. No.: WO2011/019314
PCT Pub. Date: Feb. 17, 2011

(65) Prior Publication Data

US 2012/0193080 A1 Aug. 2, 2012

(30) Foreign Application Priority Data

Aug. 12, 2009 (SE) ..... 0950584-3

(51) Int. Cl.

| | |
|---|---|
| ***A61L 2/00*** | (2006.01) |
| ***F28F 1/10*** | (2006.01) |
| ***F28F 9/02*** | (2006.01) |
| ***F16K 11/00*** | (2006.01) |
| ***F28D 7/06*** | (2006.01) |
| ***F28F 9/013*** | (2006.01) |

(52) U.S. Cl.
CPC ..... *F28D 7/06* (2013.01); *F28F 9/0131* (2013.01); *F28F 9/0275* (2013.01); *F28F 2240/00* (2013.01); *F28F 2265/26* (2013.01)

(58) Field of Classification Search
CPC ..... A61L 2/00; A61L 2/07
USPC ..... 422/1, 26, 38, 256, 292, 300, 307; 165/172–173; 137/238
See application file for complete search history.

(56) References Cited

U.S. PATENT DOCUMENTS

| | | | |
|---|---|---|---|
| 2,130,361 | A | 9/1938 | Muncie |
| 2,256,882 | A | 9/1941 | Sebald |

(Continued)

FOREIGN PATENT DOCUMENTS

| | | | |
|---|---|---|---|
| DE | 1501463 | A1 | 10/1969 |
| EP | 0235422 | B1 | 11/1990 |
| GB | 505810 | A | 5/1939 |
| GB | 704232 | * | 10/1949 |
| GB | 704232 | | 2/1954 |

(Continued)

OTHER PUBLICATIONS

International Search Report for PCT/SE10/050844.

*Primary Examiner* — Monzer R Chorbaji
(74) *Attorney, Agent, or Firm* — MKG, LLC

(57) ABSTRACT

The present invention relates to a heat exchanger system for incorporation in a deodorizer. The heat exchanger system comprises longitudinal heat transfer means, inlet distribution headers, outlet collector headers, spacers having holes to support the longitudinal heat transfer means, a compensator, and two or more support devices. The longitudinal heat transfer means are guided through the holes of the spacers and arranged in bundles, and each of the bundles is attached to an inlet distribution header as well as to an outlet collector header, and at least some of the spacers are mounted on at least one support device. The present invention relates also to a semi-continuous deodorizer having one or more of such heat exchanger systems, and to a use of the deodorizer.

19 Claims, 6 Drawing Sheets

(56) References Cited

U.S. PATENT DOCUMENTS

| | | | |
|---|---|---|---|
| 2,280,896 | A | 4/1942 | Dean |
| 3,370,741 | A | 2/1968 | Porter |
| 3,999,966 | A | 12/1976 | Naylor |
| 4,599,143 | A | 7/1986 | Stage |
| 4,626,387 | A | 12/1986 | Dodds |
| 6,953,499 | B2 | 10/2005 | Kellens et al. |

FOREIGN PATENT DOCUMENTS

| | | | |
|---|---|---|---|
| JP | 54026512 | | 2/1979 |
| RU | 2153643 | C1 | 7/2000 |
| SU | 946639 | A1 | 7/1982 |
| SU | 1528519 | A1 | 12/1989 |
| WO | 2006118517 | A1 | 11/2006 |

* cited by examiner

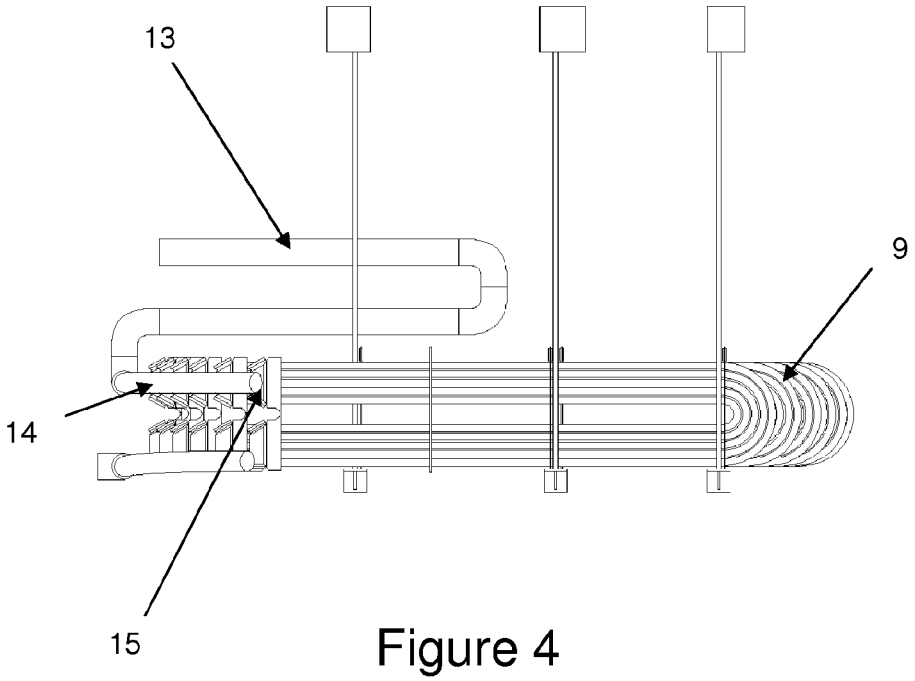
Figure 4
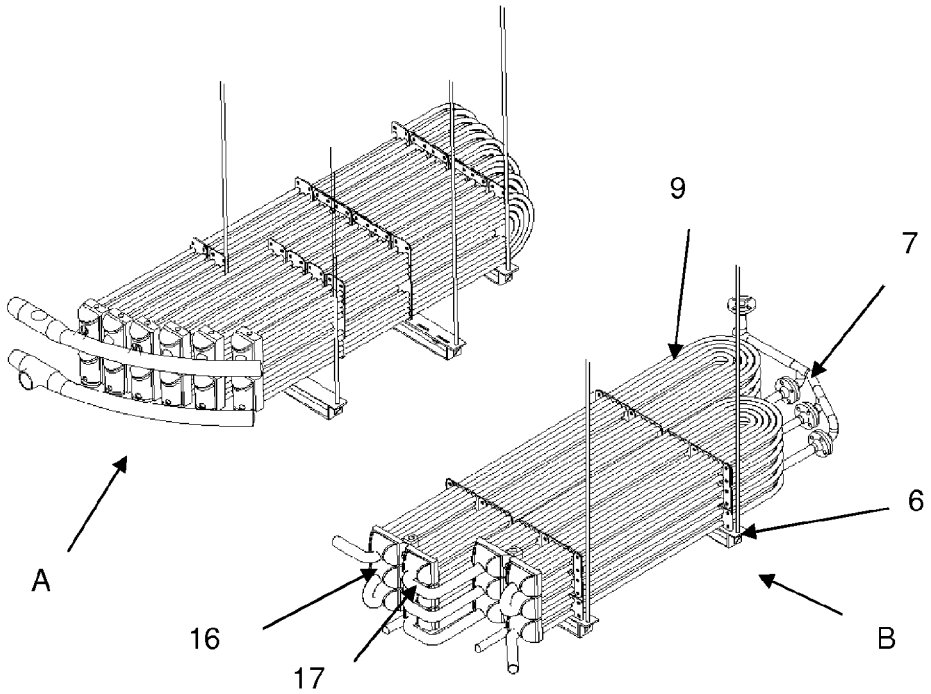
Figure 5 (A and B)

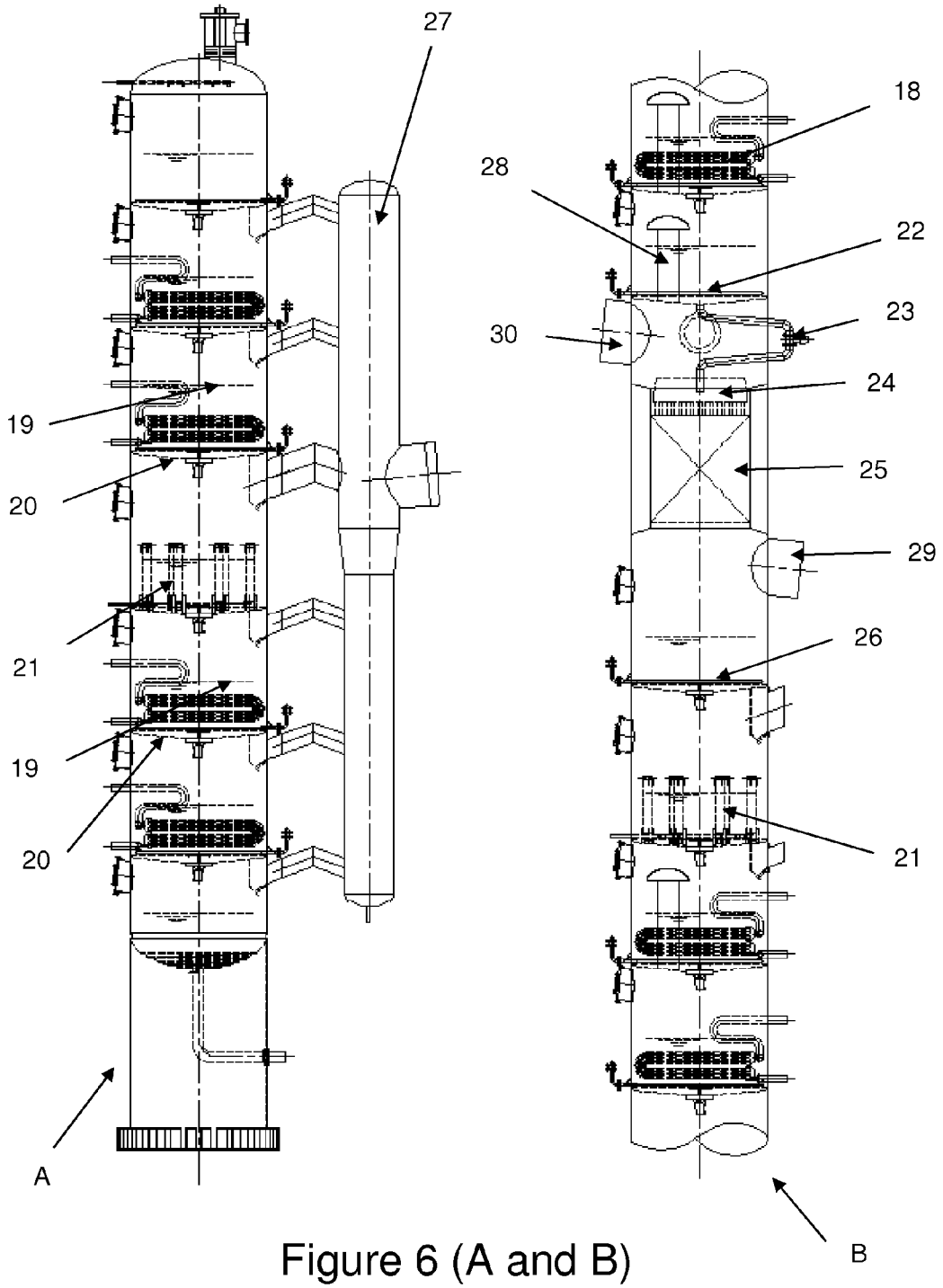
Figure 6 (A and B)

HEAT EXCHANGER SYSTEM FOR A DEODORISER

FIELD OF THE INVENTION

The present invention relates to a heat exchanger system, a deodorizer, use of the deodorizer and a method for heating or cooling in a deodorizer.

BACKGROUND

Deodorizing of edible fats and oils is an important step in the refining process. One deodorizer design class includes a vacuum vessel containing a plurality of vertically stacked trays, in which the oil consecutively is transferred from tray to tray. A sub class of the tray-based deodorizer type is operating in semi-continuous mode where the batch of oil residing in a tray is kept as a separate entity during the transferring to other trays. This semi-continuous mode allows for stock change without interrupting the operation, but induces instantaneous and significant material temperature changes at the time of batch-switch.

In deodorizers of tray-based semi-continuous type the heating or cooling of the oil is suitably executed in dedicated trays where heat exchanging coils are arranged in zones for heating and cooling. The heat exchanger coils of the current state of art are either of helical or of serpentine design. The spiral coil design inevitably leads to an empty space in the centre, in which no heat transfer area exist, this is negatively affecting which total heat transfer surface area which can be installed. Furthermore, the structure of the heat exchanger is quite rigid, leading to material fatigue and eventually coil crack due to the thermally induced expansion or contraction derived from frequent switching of oil batches of different temperatures.

SUMMARY

Accordingly, the present invention addresses the mentioned problems by providing in one aspect a heat exchanger system, which makes it possible to install more heat exchange area in a certain tray diameter and drastically reduce thermal stress and fatigue cracks. Thus, the present invention relates to a heat exchanger system for a deodorizer, which heat exchanger system includes longitudinal heat transfer means for heat transfer fluids, inlet distribution headers, outlet collector headers, spacers having holes to support the longitudinal means, and two or more support devices. The design also allows suitable integration of the heat exchanger with a gas sparge system used for controlled agitation of the oil, which is important for the overall heat transfer.

The longitudinal heat transfer means are guided through the holes of the spacers and arranged in bundles, and each of the longitudinal heat transfer means in the bundles is attached to an inlet distribution header and is attached to an outlet collector header, and some of the spacers are mounted on at least one support device. The heating surface of the longitudinal heat transfer means is distributed throughout the entire cross-section of the deodorization vessel, which leads to incorporation of more surface area per volume. A larger heat area per tray gives better heat recovery, which will lead to lower energy consumption and $CO_2$ emission per kilogramme processed oil. The longitudinal heat transfer means could for instance be U-tubes, but any type of suitable longitudinal forms could be used according to the invention.

The longitudinal heat transfer means according to the present invention are especially effective in compacting the heat surface area just above the tray-bottom, allowing lower liquid height, which results in higher capacity turn-down and better stripping efficiency. The present invention provides thus more flexible solutions to different deodorization processes and could therefore be adapted to specific applications. A further benefit of the new heat exchanger system is that the equipment manufacturing costs, which are less than that of the helical or the serpentine types.

The heat exchanger system could also include at least one compensator connected to a header manifold, which could be an inlet header manifold or to an outlet header manifold. The compensator further reduces the thermal stress in the structure. The position of the compensator is either vertical or horizontal in the heat exchanger system, and preferably the compensator is connected above the longitudinal means. It is also possible that the compensator is connected below the heat exchanger system. Preferably the compensator is connected to the longitudinal heat transfer means which are filled with two phase heat transfer fluids. The two phase heat transfer fluids are suitable liquids and vapours.

The heat exchanger system could include a pipe arrangement for distribution of agitation agent, stripping gas or for stripping steam, hereinafter called agitation/stripping agent. One of the functions of the agitation/stripping agent is to create agitation, and the agitation/stripping agent could be dosed or regulated. The pipe arrangement could be guided through at least one of the support devices, onto which support devices the spacers are mounted. The spacers could for instance be tube sheets, but any other suitable spacer could be selected, the spacers are arranged to support the longitudinal heat transfer means guided through the holes of the spacer. The first set of support devices could be connected to a second set of support devices, and the support devices could be connected by flexible means such as rods, chains, wires, or combinations thereof, to each other. The two sets of support devices are supporting the bundles of longitudinal means, which are arranged between the two sets of support devices. The support devices could be support beams. Thus, one support beam is connected to a second support beam above the first support beam.

The heat exchanger system could further include at least one manifold which distributes heat transfer fluid to the inlet distribution headers and at least one manifold which collects heat transfer fluid from the outlet collector headers. The longitudinal heat transfer means could be mounted in any positions such as horizontal position, vertical position, a slant position or combinations thereof, and the longitudinal heat transfer means are filled with heat transfer fluid having one or two phases, the two phase heat transfer fluids are liquid and vapour. The longitudinal heat transfer means filled with two phase heat transfer fluid are preferably mounted in vertical position and are connected parallel to each other. The heat transfer fluids, liquids or vapours, could be any suitable fluid, but preferably are the fluids selected from one or more of the fluids of the group containing water, brine (i.e. salt+water), steam, thermal oil, glycol, product oils, product fats, or fatty acid distillate.

The heat exchanger system according to the invention includes further that the longitudinal heat transfer means suitable are U-tubes, the spacers suitable are tube sheets, and the support devices suitable are support beams.

All heating elements including supports are herein defined as the heat exchanger system of the present invention. The system is subjected to thermal expansion or contraction due to temperature gradient exposure caused by the rapid filling of the tray with oil having a different temperature than the heat exchange system. The shell and tray are elements which are holding a liquid volume which is heated or cooled by the heat exchanger system. The longitudinal heat transfer means are arranged as bundles, and the bundles could be connected to each other either in series or parallel to each other in the heat exchanger system. The individual heat transfer means could be designed as a single longitudinal U-tube formed element, but other designs are also possible. The bundles are suitably mounted with spacer elements, for example tube sheets but other types of spacer elements are also possible, to enable a tight stacking of the bundles. The stacked bundles could be flexibly supported by the support beams. Thus, the new design enables a denser and more flexible design than that of the helical or serpentine coils, and the design makes it possible to distribute the heat area through the entire cross-section of the vessel. By using a U-tube design of the heat exchanger system, the heat expansion or the heat contraction of the design will be directed along the longitudinal axis of the tubes, and expansion or contraction in other directions are insignificant.

The systems are parted into several single heating elements which are interconnected with headers. The headers are designed as free supported elements, which are allowed to expand or contract freely in longitudinal direction. The headers connecting point to the single heating elements, are defined by the thermal expansion of the header. Each single heating element of the systems is made flexible in respect to movements of the header to allow the systems to expand freely. The systems are kept in position inside a tray during different operating conditions by tube sheets, headers and other supporting means such as rods, chains, wires, or combinations thereof.

The headers distribute or collect the heat transfer fluids to each connected bundle of longitudinal means. The pipe of the longitudinal heat transfer means is guided through a pipe hole in the spacer allowing the longitudinal heat transfer means to have flexible movements in the area of the tray.

The bundles of longitudinal heat transfer means which are in series to each other could be used for cooling but they could also be for heating in some applications, and the bundles of longitudinal heat transfer means which are parallel to each other could be used for heating but not necessary they could also be for cooling in some applications. The parallel tubes may be used as reboilers or condensators.

The present invention relates also to a deodorizer, which includes at least one heat exchanger systems according to the present invention. The heat exchanger system preferably could have the longitudinal heat transfer means mounted in vertical position but horizontal position is also applicable. The longitudinal heat transfer means are connected parallel and/or in series to each other, and the heat exchanger system includes a compensator for condensation of vapour. The deodorizer could either be continuous or semi-continuous.

When the deodorizer is a semi-continuous deodorizer then the deodorizer includes either at least one stripping section, which stripping section can be of a design comprising either a feed buffer tray, regulating means, a fluid distributer, structured packing, and a receiver tray, or comprising a holding tray operated by Mammoth pump, or combinations of the above mentioned designs.

The heat exchanger systems in the deodorizer according to the present invention could be connected to each other for recycling of heat transfer fluids, thus the heat transfer fluids could be used both for heating and cooling in the same semi-continuous deodorizer. The connections of the heat exchanger systems could be by pipes or ducts, which could be internal or external or combinations of internal and external pipes or ducts. According to the invention could the deodorizer include a combination of heat exchanger systems according to the invention and systems with heat exchanger coils. The connecting pipes or ducts could be internally or externally or combinations of internal and external pipes or ducts. The semi-continuous deodorizer could thus have two or more heat exchanger systems, which heat exchanger systems either could be heat exchanger systems having longitudinal heat transfer means in horizontal position, or heat exchanger systems having longitudinal heat transfer means in vertical position, or wherein deodorizer could have both heat exchanger systems having longitudinal heat transfer means in horizontal position, and heat exchanger systems having longitudinal heat transfer means in vertical position, or deodorizer could have both heat exchanger systems having longitudinal heat transfer means and systems with heat exchanger coils as mentioned above. The deodorizer according to the invention could also have internal or external ducts for stripping gas or stripping steam.

The present invention relates further to use as a continuous deodorizer or a semi-continuous deodorizer for deodorization of fats and/or oils. The fats and oils could be any type of vegetable or edible fats and oils. Fats and oils of this invention are classified as, but not limited to palm oil, palm kernel oil, coconut oil, tallow, lard, soybean oil, canola or rapeseed oil, cottonseed oil, corn or maize oil, sunflower oil, safflower oil, rice bran oil, olive oil, cocoa butter, sal fats, illipe butter, shea butter, milk butter, fish oils, groundnut oil, camellia oil, various types of exotic fats and oils, or oil-derivatives such as ethyl or methyl esters, etc.

The present invention relates further to a method for heating and cooling a deodorization tower, a deodorizer, or a semi continuous deodorizer according to the invention. The method includes also that heated heat transfer fluids from a cooling system are cooled in a heating system, and the cooled heat transfer fluids are heated in the cooling system. The method includes leading heat transfer fluids through one or more heat exchanger system according to the invention and leading a heat transfer fluid through at least one heat exchanger system having longitudinal heat transfer means for example U-tubes in series to each other, and the method includes further that heat accumulated in a heat transfer fluid collected from a cooling system is used for heating purpose in a heating system, and the thus cooled heat transfer fluid is re-cycled and re-heated in the same cooling system, and wherein the heat transfer fluid is lead in the longitudinal heat transfer means under pressure.

The present invention is further defined by the independent claims and the dependent claims.

In the following will the invention be explained by the use of FIGS. 1 to 7. The figures are for the purpose of demonstrating the invention and are not intended to limit its scope.

BRIEF DESCRIPTION OF THE FIGURES

FIG. 4 is showing a compensator mounted on top of vertical U-tubes.

FIG. 5 is showing two sets of U-tubes, one vertical set connected in parallel and one horizontal set connected in series according to the invention.

FIG. 6 is showing two deodorization towers according to the invention having heat exchanger trays according to the invention.

DETAILED DESCRIPTION

Figure 1:
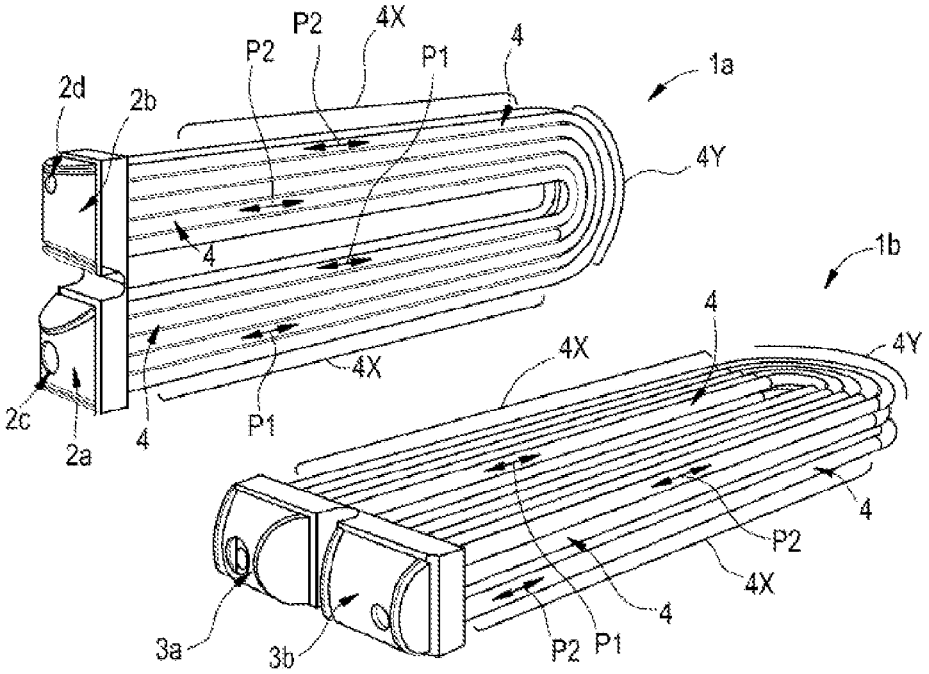
FIG. 1 is showing two views of longitudinal heat transfer means for heat transfer fluids in form of U-tubes arranged in modules, in vertical and horizontal position according to the invention.

FIG. 1 is showing two bundles of longitudinal heat transfer means 1*a* and 1*b* for heat transfer fluids. Bundle 1*a* is an example of a bundle of a plurality of U-tubes 4 in a vertical position and 1*b* is an example of a bundle in a horizontal position. In the vertical position 1*a*, the flows P1 and the flows P2 are arranged in a vertical side by side configuration, for example, inlet flow P1 below outlet flow P2. In the horizontal position 1*b*, the flows P1 and the flows P2 are arranged in a horizontal side by side configuration. Vertical bundle 1*a* is attached to two headers 2*a* and 2*b*, both headers are equipped with holes, header 2*a* has a hole 2*c* and header 2*b* has a hole 2*d*. In FIG. 1 are hole 2*d* smaller than hole 2*c*, and small hole 2*d* is above hole 2*c*, but it could also be the other way around. Thus, hole 2*d* could be larger than hole 2*c*, and larger hole 2*d* would therefore be above smaller hole 2*c*. The size of the holes and the position depend on the function of bundle 1*a*. The position of the header and the header functions depend on the application. If feeding a fluid that is supposed to change phase inside the tubing, the flow direction is selected so that vapour phase always will pass the upper header. The upper header 2*b* thus acts as an outlet collector in case of using the heat exchanger as oil cooler, producing fluid vapour inside the tubing, and acts as inlet distributor if using the exchanger as heater producing condensate inside tubing. Also horizontal bundle 1*b* is attached to an inlet distribution header 3*a* and to an outlet collector header 3*b*. The horizontal arrangement is best suited for single phase fluids. Each of the U-tubes in the bundle 1*a* defines the flow paths designated by double headed arrows P1 and P2 between the header 2*a* and the header 2*b*. Each of the U-tubes in the bundle 1*b* defines the flow paths P1 and P2 between the header 3*a* and the header 3*b*. In one embodiment, the term bundle refers to the plurality of U-tubes defining multiple flow paths P1 and P2. As shown in FIG. 1, the longitudinal heat transfer means 4 of bundle 1*a* defines straight sections 4X located between the header 2*a* and the header 2*b*; and the longitudinal heat transfer means 4 of bundle 1*b* defines straight sections 4X located between the header 3*a* and the header 3*b*. The straight sections 4X of the longitudinal heat transfer means 4 of bundle 1*a* are joined to one another by a U-shaped portion 4Y; and the straight sections 4X of the longitudinal heat transfer means 4 of bundle 1*b* are joined to one another by a U-shaped portion 4Y.

Figure 2:
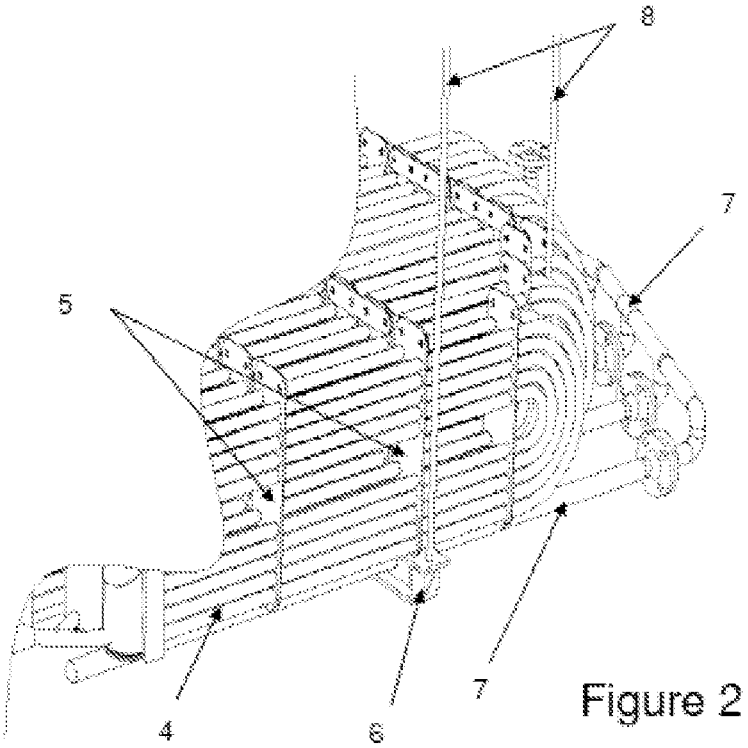
FIG. 2 is showing U-tube modules as an example, arranged in vertical position as part of internals of a heat exchanger tray according to the invention.

FIG. 2 is showing a part of internals of a heat exchanger tray having bundles defined by the plurality of U-tubes 4 in the vertical position. Each tube 4 is guided through spacers 5 having holes to support the longitudinal heat transfer means, in this case the U-tubes. At least some of the spacers 5 are mounted on at least one support device 6. Support device 6 is in this figure a beam. FIG. 2 shows also how pipes 7 for agitation/stripping agent are guided through the support devices 6. By this arrangement of the pipes it is made possible to further support the longitudinal heat transfer means 5, but it is not necessary that all heat exchanger trays have this extra support. Support device 6 is connected to a second support device, not seen in the figure, and the support devices are inter-connected by flexible means 8 such as rods, chains, wires, or combinations thereof. The two support devices are supporting the bundles of longitudinal heat transfer means arranged between the two support devices, and the arrangement is made flexible that heat expansion of the longitudinal heat transfer means can occur without any stress to the equipment. Also spacers 5 are permitting the longitudinal heat transfer means to move freely.

Figure 3:
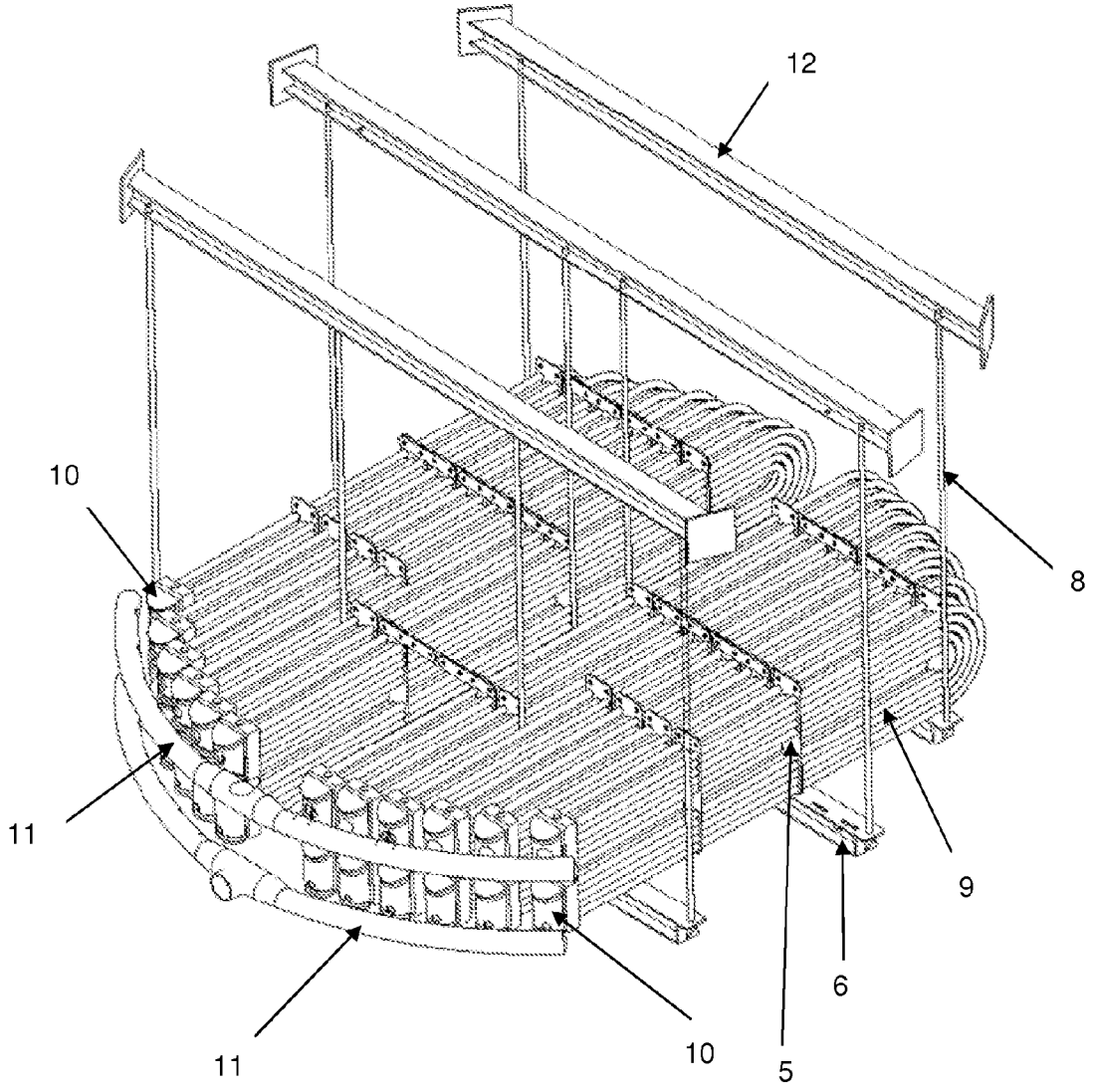
FIG. 3 is showing a complete U-tube arrangement supported by devices according to the invention.

In FIG. 3 it is shown how the arrangement of longitudinal heat transfer means 9 are designed to fit the inner space of a deodorization tray to optimize the heat transfer area by distributing the heating transfer area throughout the entire cross-section of the tray, which walls are not seen in the figure. The vertical longitudinal heat transfer means are connected via headers 10 to two manifolds 11 which connect vertical longitudinal heat transfer means 9 in a parallel fashion. Headers 10 are either inlet distribution headers or outlet collection headers, each type inter-connected to a manifold. The figure shows how support device 6 is connected to support device 12 or to holding device 12. The internals which includes longitudinal heat transfer means 9, headers 10, spacers 5 etc. are supported by support devices 6 and are flexible hanging from support devices 12 via flexible means 8, this arrangement can thus move and any material stress can be avoided. The compact arrangement of the internals also increases the heating surface area per tray volume. The enhanced heat area per tray gives better heat recovery.

FIG. 4 shows how a compensator 13 is connected to outlet manifold 14 connected to outlet collector headers 15. Compensator 13 is in vertical position in this figure but the compensator could also be in a horizontal position or a position in between. Horizontal position is preferred in general to ensure that the compensator is immersed into the tray liquid, thus avoiding pipe temperature differences etc. However, vertical position is preferred in case of producing vapour on the tube side as the rising pipe facilitates better liquid/vapour separation. Even if the figure shows vertically arranged longitudinal heat transfer means 9, compensator 13 could also be connected to horizontally arranged longitudinal heat transfer means.

FIGS. 5A and 5B shows two types of arrangements of longitudinal heat transfer means and how the heat transfer means are connected to each other in the two different arrangements. FIG. 5A is a vertical arrangement of the longitudinal heat transfer means which are connected parallel. FIG. 5B shows a horizontal arrangement of longitudinal heat transfer means 9, herein form of U-tubes. Two headers 16 are connected to longitudinal heat transfer means 9, one at the inlet and one at the outlet ports. The headers are connected in series in FIG. 5B, this means that the outlet header belonging to one tube bundle is connected to an inlet header belonging to another tube bundle via an external pipe 17, and the inlet header is connected to the inlet of the U-tubes, which U-tubes inter-connects to an outlet header and so on. FIG. 5B shows also that pipes 7 for agitation/stripping agent could be arranged under longitudinal heat transfer means 9 and which pipes are guided through support devices 6.

FIGS. 6A and 6B shows two alternatives of the semi continuous deodorizer according to the invention, in these figures only vertical arrangements of longitudinal heat transfer means 18 are shown but one or more could be exchange with horizontal arranged longitudinal heat transfer means. In FIG. 6A liquid height 19 can be seen in trays 20, by the use of the heat exchanger system according to the invention could liquid height 19 be lowered compared to the systems with the coils. The deodorizers include one or more heat exchanger systems. Agitation/stripping agent is brought into intimate contact with the heated oil, thereby stripping off volatile components. The residence time provokes desired thermal decomposition of various components at the same time as the stripping. The major stripping could be done in trays with Mammoth pumps 21 or in a stripping section, while only minor stripping is taking place in the heat exchanger trays where agitation/stripping agent first of all is dosed to increase the heat transfer. In FIG. 6A deodorizer A is equipped a tray with Mammoth pumps 21 as stripping section. Mammoth pumps 21 works according to the principle that agitation/stripping agent is injected in the bottom of the vertical pipes which act as Venturi-like nozzles carrying oil from the bottom of the tray to above the liquid surface, where the spray effect enables the volatiles to be transferred into the gas phase and thus be removed from the oil.

In FIG. 6B deodorizer B is equipped both a tray with Mammoth pumps 21 and with a stripping section. The deodorizer could have two or more stripping sections as an alternative. The stripping section includes a feed buffer tray 22 for flow of fluids, flow regulating means 23, a liquid distributer 24, structured packing 25, and a receiver tray 26. Regulating means 23 are regulating the liquid flow from feed buffer tray 22 to distributer 24. Distributer 24 distributes the liquid over the cross-sectional area of the structured packing 25. Incorporation of a structured packing into the tray-based Semi-Continuous Deodorizer (SCD) increases the stripping efficiency and enabling Physical Refining at lower steam consumption and holding time than in SCDs only equipped with Mammoth pumps. FIGS. 6A and 6B show also that the deodorizers have either external ducts 27 or internal ducts 28 for handling of the vapour phase. The vapour could be collected and re-inlet into the deodorizer through duct 29 and contacting the oils in a counter current fashion through structure packing 25 and let out through duct 30.

Figure 7:
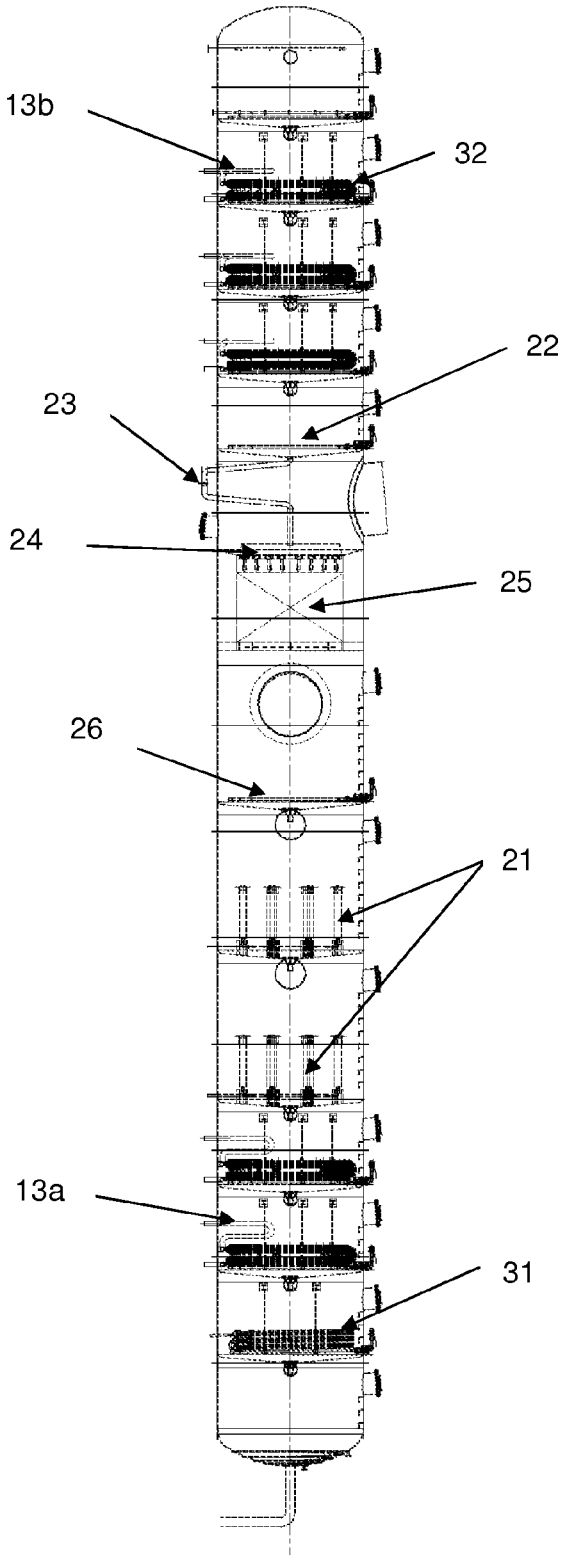
FIG. 7 is showing another deodorization tower according to the invention having heat exchanger trays according to the invention.

FIG. 7 is showing a deodorizer also equipped trays with Mammoth pumps 21 and with a stripping section comprising a feed buffer tray 22, flow regulating means 23, a liquid distributor 24, structured packing 25, and a receiver tray 26. In FIG. 7 it can be seen that the deodorizer also can have trays with horizontal U-tubes 31 and trays with vertical U-tubes 32. The figure shows that compensators 13 can either be in vertical position 13*a* or in horizontal position 13*b*.

Figure 8:
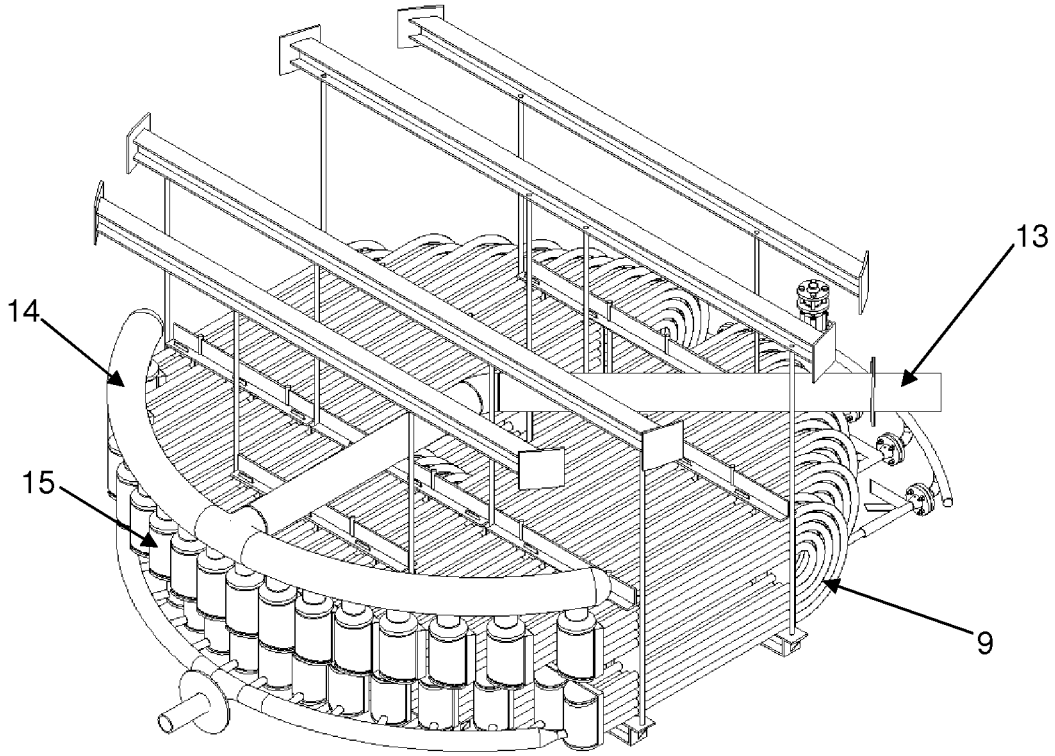
FIG. 8 is showing another embodiment according to the present invention wherein a compensator is mounted on top of vertical U-tubes.

FIG. 8 is showing another embodiment of the invention wherein a compensator is mounted on top of vertical U-tubes in a different way than is shown in FIG. 4. According to this embodiment compensator 13 is connected to outlet manifold 14, which is connected to outlet collector headers 15. Manifold 14 is according to this version placed above collector headers 15 and thus also above the vertical U-tubes, even if this figure shows vertically arranged longitudinal heat transfer means 9, compensator 13 could also be connected to horizontally arranged to longitudinal heat transfer means. Compensator 13 is placed in same elevation as outlet manifold 14, but compensator 13 is still bended as in FIG. 4 for compensation of temperature differences etc. in pipe and tray liquid. Outlet collector headers 15 are connected to manifold 14 vertically according to this embodiment.

What is claimed is:

1. A heat exchanger system for a deodorizer comprising longitudinal heat transfer means for heat transfer fluids, inlet distribution headers, outlet collector headers, spacers having holes to support the longitudinal heat transfer means, two or more support devices, the longitudinal heat transfer means comprising at least one straight section located between the inlet distribution header and the outlet collection header, wherein the longitudinal heat transfer means are guided through the holes of the spacers and arranged in bundles, and each of the longitudinal heat transfer means in the bundles is attached to an inlet distribution header and is attached to an outlet collector header, and at least some of the spacers are mounted on at least one support device.

2. The heat exchanger system according to claim 1, wherein the heat exchanger system also comprises at least one compensator connected to the headers, and the compensator is either in vertical or horizontal position.

3. The heat exchanger system according to claim 2, wherein the compensator is connected to the upper manifold, and wherein the headers are connected to the bundles of longitudinal heat transfer means, and the two phase heat transfer fluids are liquid and vapour.

4. The heat exchanger system according to claim 1, wherein the heat exchanger system also comprises a pipe arrangement for controlled distribution of agitation/stripping agent guided through at least one of the support devices, onto which support devices the spacers are mounted.

5. The heat exchanger system according to claim 1, wherein one support device is connected to a second support device, and the support devices are connected by flexible means such as rods, chains, wires, or combinations thereof, which two support devices are supporting the bundles of longitudinal heat transfer means arranged between the two support devices.

6. The heat exchanger system according to claim 1, wherein at least one manifold is distributing heat transfer fluid to the inlet distribution headers and at least on manifold is collecting heat transfer fluid from the outlet collector headers.

7. The heat exchanger system according to claim 1, wherein the longitudinal heat transfer means are mounted in any positions such as horizontal position, vertical position, a slant position or combinations thereof, and the longitudinal heat transfer means are filled with heat transfer fluid having one or two phases.

8. The heat exchanger system according to claim 1, wherein the longitudinal heat transfer means filled with two phase heat transfer fluids preferably are mounted in vertical position and are connected in parallel to each other.

9. The heat exchanger system according to claim 1, wherein the longitudinal heat transfer means are U-tubes, the spacers are tube sheets, and the support devices are support beams.

10. The heat exchanger system according to claim 1, wherein the heat transfer fluids are selected from one or more fluids of the group containing water, steam, thermal oil, glycol, product oils, product fats, oil distillate.

11. A deodorizer comprising two or more heat exchanger systems according to claim 1, and wherein the heat exchanger systems are either heat exchanger systems having the longitudinal heat transfer means in a horizontal position, or heat exchanger systems having the longitudinal heat transfer means in a vertical position, or wherein the deodorizer has a combination of heat exchanger systems having the longitudinal heat transfer means in the horizontal position, and heat exchanger systems having the longitudinal heat transfer means in the vertical position, and wherein the deodorizer is either a continuous deodorizer or a semi-continuous deodorizer;

in the horizontal position inlet flows through the longitudinal heat transfer means and outlet flows through the longitudinal heat transfer means are arranged in a horizontal side by side configuration; and in the vertical position inlet flows through the longitudinal heat transfer means and outlet flows through the longitudinal heat transfer means are arranged in a vertical side by side configuration.

12. The deodorizer according to claim 11, wherein the deodorizer is a semi-continuous deodorizer comprising at least one stripping section comprising a feed buffer tray, flow regulating means, a liquid distributor, structured packing, and a receiver tray, or the deodorizer comprises mammoth pump trays, or the semi continuous deodorizer comprises combinations of stripping sections and mammoth pump trays.

13. The deodorizer according to claim 11, wherein the heat exchanger system preferably has the longitudinal heat transfer means mounted in vertical position and the longitudinal heat transfer means are connected parallel to each other.

14. A method for heating and cooling a deodorizer according to claim 11, which method comprises leading a heat transfer fluids through at least one heat exchanger system having the longitudinal heat transfer means in series and leading the heat transfer fluids through at least one heat exchanger system having the longitudinal heat transfer means parallel to each other, and the method comprises further that heated heat transfer fluids from a cooling system are cooled in a heating system, and the cooled heat transfer fluids are heated in the cooling system, and wherein the heat transfer fluids are lead in the longitudinal heat transfer means under pressure.

15. The heat exchanger system according to claim 11, wherein the spacers are configured to permit the longitudinal heat transfer means to move relative thereto in response to thermal expansion of the longitudinal heat transfer means.

16. The heat exchanger system according to claim 11, wherein each of the bundles define a plurality of tubes defining multiple flow paths.

17. A method for heating and cooling a semi continuous deodorizer, which method comprises leading a heat transfer fluid through at least one heat exchanger system according to claim 1, leading the heat transfer fluids through at least one heat exchanger system having the longitudinal heat transfer means in series to each other, and the method comprises further collecting heat transfer fluids from a cooling heat exchanger system having the longitudinal heat transfer means parallel to each other, accumulation of heat in the heat transfer fluids collected from the cooling system, heating the heat exchanger fluids in a heating system, and wherein the heat transfer fluid is lead in the longitudinal heat transfer means under pressure.

18. The heat exchanger system according to claim 1, wherein the spacers are configured to permit the longitudinal heat transfer means to move relative thereto in response to thermal expansion of the longitudinal heat transfer means.

19. The heat exchanger system according to claim 1, wherein each of the bundles define a plurality of tubes defining multiple flow paths.

* * * * *